US006238266B1

(12) United States Patent
Vogt

(10) Patent No.: US 6,238,266 B1
(45) Date of Patent: May 29, 2001

(54) SUPPORT GARMENT FABRICS WITH CROSS-LINKED POLYURETHANE LATICES COATED THEREON

(75) Inventor: Kirkland W. Vogt, Simpsonville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/704,143

(22) Filed: Nov. 1, 2000

Related U.S. Application Data

(63) Continuation of application No. 09/177,449, filed on Oct. 22, 1998, now Pat. No. 6,180,178.

(51) Int. Cl.[7] ..... A41C 3/00

(52) U.S. Cl. ..... 450/19; 450/20; 450/21; 450/74; 450/75; 450/76

(58) Field of Search ..... 450/1, 2, 3, 7, 450/8, 10, 19, 20, 21, 74, 75, 76

(56) References Cited

U.S. PATENT DOCUMENTS

| | | | |
|---|---|---|---|
| 4,316,457 | 2/1982 | Liegois | 128/156 |
| 5,188,585 | 2/1993 | Peters | 602/19 |
| 5,368,925 | 11/1994 | Hosokawa et al. | 428/281 |
| 5,731,062 | 3/1998 | Kim et al. | 428/175 |
| B1 4,411,262 | 7/1985 | Von Bonin et al. | 128/90 |

FOREIGN PATENT DOCUMENTS

| | | |
|---|---|---|
| 276118 | 7/1988 | (EP) . |
| 516994 | 9/1992 | (EP) . |
| 62-85087 | 4/1987 | (JP) . |

*Primary Examiner*—Erma Cameron
(74) *Attorney, Agent, or Firm*—Terry T. Moyer; William S. Parks

(57) ABSTRACT

This invention relates to support garments which provide a support function through the utilization of a dried polyurethane coating placed on certain areas of the target fabric surface. Such a coating produces a reduction in the elongation characteristics of the target fabric thereby exhibiting a manner of providing support to the target fabric which is comfortable to the wearer and inexpensive to produce. The inventive garments may be utilized as sports brassieres, swimwear, "control-top" underwear, girdles, athletic supporters, medical braces, and the like.

9 Claims, 1 Drawing Sheet

SUPPORT GARMENT FABRICS WITH CROSS-LINKED POLYURETHANE LATICES COATED THEREON

CROSS REFERENCE TO RELATED APPLICATION

This application is a continuation of application 09/177,449, filed on Oct. 22, 1998, now U.S. Pat. No. 6,180,178.

FIELD OF THE INVENTION

This invention relates to support garments which provide a support finction through the utilization of a dried polyurethane coating placed on certain areas of the target fabric surface. Such a coating produces a reduction in the elongation characteristics of the target fabric thereby exhibiting a manner of providing support to the target fabric which is comfortable to the wearer and inexpensive to produce. The inventive garments may be utilized as sports brassieres, swimwear, "control-top" underwear, girdles, athletic supporters, medical braces, and the like.

DISCUSSION OF THE PRIOR ART

Support garments have been utilized for centuries to provide methods of keeping body parts stationary (such as with knee braces), alleviating discomfort and/or making fashion statements (such as with brassieres), constraining certain areas of a person's body in order ultimately to provide an aesthetically pleasing figure (such as with girdles and the like), protecting particularly susceptible body parts from harm (such as with athletic supporters), and the like. Myriad ways of providing such methods have been developed in the past. For instance, braces have been produced which utilize high tensile strength/low elongation fibers, metal components, and cast materials. Brassieres and girdles have been fashioned from certain fabric configurations, metal wires, and, again, high tensile strength/low elongation fibers. Added padding and/or high tensile strength/low elongation fibers have been utilized to improve upon existing athletic supporter garments as well. In each of these examples, the improvements have focused on adding cumbersome and potentially uncomfortable metal wires or extra material within the body of the garment, utilizing relatively expensive high tensile strength fibers, or utilizing strips of the garment fabric placed at specific angles, all in order to provide the requisite and desired support. As such, there is a need to provide the necessary level of support for such garments without the need for increased costs and/or extra fabric material while simultaneously increasing the discomfort for the wearer.

DESCRIPTION OF THE INVENTION

It is thus an object of the invention to provide such improved support for a wearer's body parts (such as an injured knee joint, a woman's breasts, and the like) within a garment through the utilization of a relatively inexpensive polyurethane coating applied in certain strategic areas of the target fabric and subsequently dried on the fabric surface. A further object of the invention is to provide a long-lasting, inexpensive support garment. Another object of the invention is to provide a support garment which possesses suitable flexibility for placement on and around the target body part and provides excellent support upon placement at the target location. Yet another object of this invention is to provide a support garment which comprises a polyurethane latex which, upon drying, is washfast and will not appreciably displace from the fabric surface during standard wear and/or laundering processes. Still a further object of the invention is to provide a method for producing such a polyurethane latex-coated support garment.

Accordingly, this invention encompasses a method of producing a support garment comprising the steps of (a) providing a target fabric;

(b) coating at least a portion of said target fabric with a polyurethane latex; and (c) drying said polyurethane latex. Nowhere within the prior art has such a specific support garment or method of producing the same been disclosed or fairly suggested. The closest art found encompasses the mere suggestion of utilizing individual fibers of polyurethane or polyurethane latex-coated fibers in apparel, such as in U.S. Pat. No. 5,368,925, to Hosokawa et al., and U.S. Pat. No. 5,731,062, to Kim et al. There is no specific teaching or even implication, however, within these two references that a dried polyurethane latex coating of a fabric provides the benefits herein described for fabric and, in particular, for support garments. The term support garment is intended to encompass any textile utilized on a person's body for the purpose of providing support to, keeping stationary, and/or protecting a particular body part or parts. Included in this description are brassieres, most notably, but not limited to, sports bras; medical braces, such as for knees or elbows, as merely examples; support underwear, such as "control-top" panties and hosiery; and athletic supporters (i.e., jock straps). Again, this list merely describes preferred embodiments of the inventive support garment and by no means is intended to limit the scope of the invention.

Any fabric can be utilized in this invention as the important requirement is that the polyurethane latex be applied at strategic locations on the target fabric surface in order to provide proper points of support within the finished garment. Polyester is most preferred; however, any natural fibers, such as cotton, ramie, and the like; any synthetic fibers, such as polyamides, lycra, and the like; and any blends thereof of any natural and/or synthetic fibers may be utilized within the inventive fabric, such as lycra/polyester and lycra/nylon blends. Of particular interest are fabrics which possess suitable weights for incorporation within flexible support garments. As merely examples, weights of fabric in the range of between 2.0 and 12.5 ounces per square yard are preferred with more preferred possessing weights of 3.5 to about 10.5 ounces per square yard. Furthermore, knitted fabrics are preferred; however, woven and non-woven forms may also be utilized as well as combinations of any types of these forms.

The important limitation of this invention is the presence of the dried polyurethane latex coated over at least a portion of the target fabric to provide an area of decreased elongation, and thus improved support, within the target fabric. Such a coating will not appreciably be removed from the fabric surface during standard laundering procedures and proper adornment by the wearer. Also, the high tensile strength properties of the polyurethane latex will not appreciably decrease over time through the same standard laundering techniques and usual wear by the user. As such, the inventive support garment should not require replacement over short intervals of time. The resultant product thus provides a long-lasting support garment which is inexpensive to make and exhibits excellent support and comfortability for the wearer.

The preferred polyurethane component is a waterborne aliphatic or aromatic polymer which exhibits proper degrees of stress and strain on the target fabric upon application and drying. In this manner, the proper latex must provide a decrease in the elongation of the target fabric, thereby increasing the stress on the target fabric on the portions of application of the latex while simultaneously lowering the strain on the fabric in the opposite direction. The preferred polyurethane is a water-borne dispersion, particular examples of which include those within the Witcobond® polyurethane series, from Witco, such as W-232, W-234, W-160, W-213, W-236, W-252, W-290H, W-293, W-320, and W-506; most preferred is W-293; and polycarbonate polyurethanes produced by Stahl™, most notably RU-40-350. Acrylic polyurethane dispersions may also be utilized.

Any water-borne and/or water-dispersible cross-linking agent compatible with polyurethanes may be utilized within this invention, particularly those which have low amounts of free formaldehyde. Preferred as cross-linking agents are modified ethylene ureas; and more particularly those cross-linking agents sold under the tradenames Cytec™ M3 and Freerez™ PFK by Freedom Chemical. Any catalyst, which is generally necessary to initiate and effectuate cross-linking of a polyurethane dispersion, which is compatible with both a polyurethane and a polyurethane cross-linking agent maybe utilized within this invention. Preferred as a cross-linking catalyst is Cytec™ MX, available from BFGoodrich. Also present within the polyurethane latex composition is a thickening agent, such as those sold under the name Kelgin™ by Kelco.

The cross-linked polyurethane latex of the invention may be present in any amount and concentration within an aqueous solution for use on and within the target fabric. The table below indicates the difference in performance of the cross-linked polyurethane latex in reference to its concentration and dry solids addition rate on the fabric surface. Preferably, the concentration of the polyurethane is from 5 to 100% by weight of the utilized aqueous solution; more preferably from 10 to about 75% by weight; and most preferably from 25 to about 50% by weight. The coating addition rate (measured as the percent of dry solids addition on the weight of the fabric) of the cross-linked polyurethane dispersion is preferably from 3 to 50% owf; more preferably from about 6 to about 40% owf; and most preferably from about 15 to about 30% owf.

As noted below, the basic procedure followed in applying the polyurethane latex entails first providing a target fabric, such as lycra. Next, the latex is diluted with water to the desired concentration which will provide the most beneficial support function to the target fabric after treatment. The polyurethane latex is then coated on the target fabric surface through any standard manner, including printing, brushing, padding, and the like (screen printing is most preferred in order to produce specific patterns on the target fabric surface). The treated fabric is then dried and cured for a period of time, preferably at a temperature sufficient to effectuate a complete covering of the metal particles previously adhered to the target fabric surface. For example only, a temperature between about 250 and 400° F.; preferably between 300 and 400° F.; more preferably from 325 and 385° F.; and most preferably between 350 and 370° F. are workable. Times of from 1 to 30 minutes are preferred for this drying and curing step with a time between about 2 and 10 minutes most preferred.

Any other standard textile additives, such as dyes, pigments, hydrophobic agents (i.e., fluorocarbons), sizing compounds, and softening agents may also be incorporated within or introduced onto the surface of the fabric substrate. Particularly desired as optional finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference.

As noted above, this polyurethane latex-coated fabric may be incorporated into any type of support garment since the polyurethane latex provides the proper amount of stress and strain for the target fabric, particularly when coated at strategic locations on the target fabric surface. The term support garment is intended to encompass any textile product to be worn which provides any support function at all to a person's body or body parts. As merely examples, and not intended as limitations, brassieres, including sports bras, medical braces, girdles, and athletic supporters all fall within this definition.

While the invention will be described in connection with preferred embodiments and procedures, it is to be understood that the invention is in no way intended to be limited by such description. On the contrary, it is intended to cover all alternatives modifications and equivalents as may be included within the true spirit and scope of the invention as defined by the claims appended hereto.

DETAILED DESCRIPTION OF THE DRAWINGS

Figure 1:
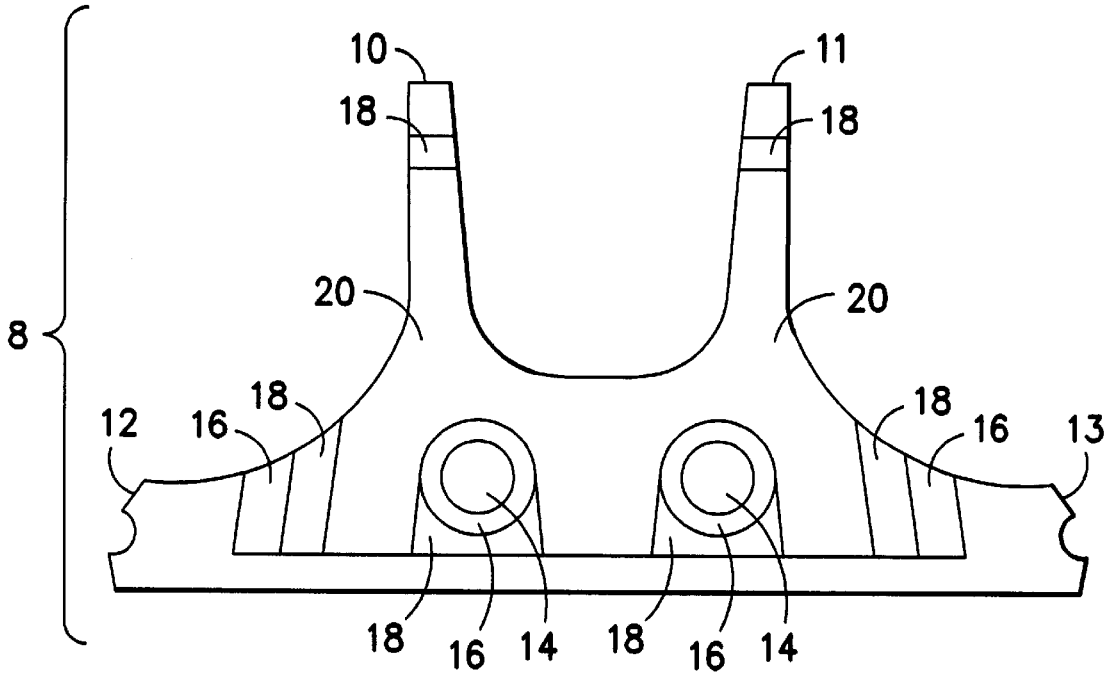
FIG. 1 is a top view of an inventive pre-sewn polyurethane-coated fabric cut so as to ultimately form a sports brassiere.

Turning now to the drawings wherein like reference numerals designate like components in the various views, in FIG. 1 there is shown a pre-sewn sports bra 8 coated with polyurethane in specifically marked areas of the fabric. The sports bra 8 is preferably made from lycra fibers, a nylon/lycra blend, or even a polyester/lycra blend, although any type of fiber utilized in the sports bra field may be utilized in this application. In the illustrated and preferred practice, the pre-sewn bra 8 includes straps 10, 11 which loop over the wearer's shoulders upon use and which are sewn, with side panel ends 12, 13 into one location in the back (not illustrated) in order to form the support garment. The pre-sewn bra 8 is coated, in one embodiment, with the polyurethane latex described above but only in certain strategic areas of the fabric. Furthermore, to effectuate the best overall support structure, differing concentrations of the latex are mixed and applied in certain locations on the fabric surface. Such concentrations included, 33% (comprising 506.6 grams Witcobond® W293; 100 grams water; and 418 grams of 6% Kelgin® LV thickener); 45% (comprising 826 g Witcobond® W293; 89 g water; and 248 g of 6% Kelgin® LV thickener); and 60% (comprising 900 g Witcobond® W293; and 110g of 6% Kelgin® LV thickener). The lower the concentration the lower the degree of support provided (and thus the greater the elongation) on the fabric. For instance, these fabric samples coated with these polyurethane latex concentrations were tested in accordance with ASTM Test Procedure D 1775-94 to investigate their resultant elongation characteristics. In comparison to the control fabric (an 80% polyester/20% lycra blend, 6 ounces per square yard tricot knit, which exhibited a 128 mm warp elongation by 74 mm fill elongation, all under 30pounds of stress, the coated samples of the same fabric provided the following elongation results:

33%—51 mm (warp) by 17 mm (fill)

45%—55 mm (warp) by 14 mm (fill)

60%—55 mm (warp) by 13 mm (fill)

Therefore, the 33% concentration latex coated samples reduced the elongation of the fabric under a 30 pound load by nearly 150% from the control, thereby providing a substantial amount of support in the target fabric. Thus, as a preferred example, a 33% concentration of the polyurethane latex was applied at those locations numbered 16, including near the axillary area and around the cup area. The cup area 14 was not coated with polyurethane latex as the support for the wearer's breasts was provided through the utilization of dried polyurethane latex around and under the cup 14. A concentration of 45% polyurethane latex was applied to those areas numbered 18, including adjacent to and closer to the torso of the wearer in the axillary area, below the cup areas 14, and at the top part of the straps 10, 11 on the wearer's shoulders. A concentration of 60% polyurethane latex was also utilized over one single large area 20 over and around the cups 14 and at the bottom portions of the straps 10, 11. To improve upon the comfortability of this garment for the wearer, a liner of fabric, such as polyester or a polyester/nylon blend, listed merely as examples, or polymeric film, such as polyethylene, again, merely as an example, may be applied over at least a portion of the polyurethane coated areas of the bra 8 (and potentially over the entire fabric) since the dried polyurethane may irritate the skin (due only to a rough feel). An empirical test was also undertaken by a number of women to test the support and comfortability of the inventive garment as compared with an uncoated standard sports brassiere. Each test subject agreed that the inventive bra provided a greater amount of support than the uncoated control with the same degree of comfortability.

Figure 2:
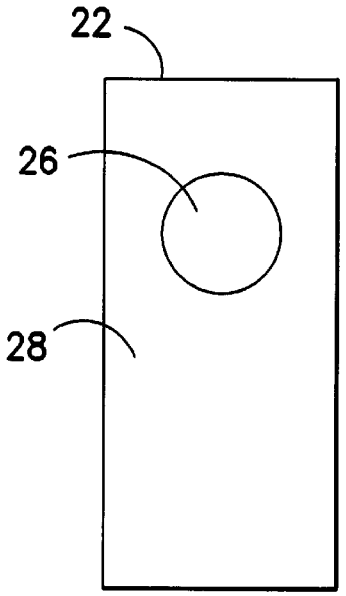
FIG. 2 is a side view of an inventive polyurethane-coated elbow brace.
Figure 3:
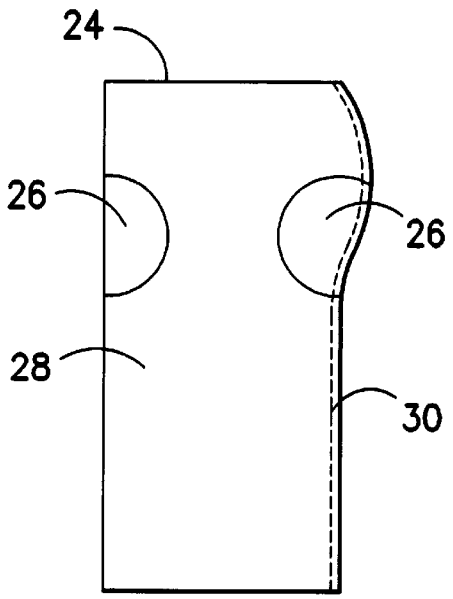
FIG. 3 is a side view of the brace of FIG. 2 rotated clockwise 90°.

Turning to FIGS. 2 and 3, an inventive elbow brace 22 is illustrated comprising a polyurethane latex coating of 40% concentration applied to the (preferably 60% nylon/40% lycra 6 ounces per square yard) tricot knit fabric in a large area over the brace 28. Two separate pieces of fabric 22, 24 were sewn together to form the brace 28. The brace 28 was constructed in a manner comparable to the configuration of a standard commercial neoprene elbow brace. The entire brace 28, except for the uncoated sections 26 which allow for freedom of movement of the effected joint, was coated with a 40% concentration polyurethane latex composition comprising 100 parts of RU-40-350 polyurethane (from Stahl™), 2 parts Freerez™ PFK crosslinker (Freedom Chemical), and 20 parts of 6% Kelgin® LV thickener (Kelco). The fabric was dried and cured at 300° F. for 3 minutes, and then washed to remove any excess thickener. The final dry solids addition rate on the fabric was about 25% owf. The single piece construction was sewn together by a single long stitch 30 (FIG. 3) and the finished product easily slid over the wearer's arm and over the target elbow. Such an inventive brace permitted freer movement with limited elongation as well as less bunching of the fabric in the forearm area thereby providing more comfortability to the wearer, particularly in comparison with the standard commercial neoprene elbow braces. As with the bra of FIG. 1, test subjects objectively compared the inventive brace with a neoprene brace. As above, the inventive brace provided substantial support (as much as the commercial brace) but with a greater degree of comfortability than the neoprene brace.

There are, of course, many alternative embodiments and modifications of the present invention which are intended to be included within the spirit and scope of the following claims.

What I claim is:

1. A support garment comprising a support garment target fabric; wherein at least a portion of said target fabric is coated with a cross-linked water-borne polyurethane latex.

2. The support garment of claim 1 wherein said target fabric is comprised of synthetic fibers.

3. The support garment of claim 2 wherein said target fabric is comprised of synthetic fibers selected from the group consisting of polyester, polyamide, spandex, and any blends thereof.

4. The support garment of claim 1 wherein said support garment is a brassiere.

5. The support garment of claim 2 wherein said support garment is a brassiere.

6. The support garment of claim 3 wherein said support garment is a brassiere.

7. The support garment of claim 1 wherein said support garment is a medical brace.

8. The support garment of claim 2 wherein said support garment is a medical brace.

9. The support garment of claim 3 wherein said support garment is a medical brace.

* * * * *